US006568342B2

(12) United States Patent
Mielke et al.

(10) Patent No.: US 6,568,342 B2
(45) Date of Patent: May 27, 2003

(54) SLIDING DECK ASSEMBLY PROVIDING ENGINE COMPARTMENT ACCESS

(75) Inventors: Dan Mielke, New Smyrna Beach, FL (US); Scott Wood, New Smyrna Beach, FL (US)

(73) Assignee: Boston Whaler, Inc., Edgewater, FL (US)

( * ) Notice: Subject to any disclaimer, the term of this patent is extended or adjusted under 35 U.S.C. 154(b) by 0 days.

(21) Appl. No.: 09/780,974

(22) Filed: Feb. 9, 2001

(65) Prior Publication Data

US 2001/0025595 A1 Oct. 4, 2001

Related U.S. Application Data

(60) Provisional application No. 60/181,643, filed on Feb. 10, 2000.

(51) Int. Cl.[7] ..... B63B 19/18
(52) U.S. Cl. ..... 114/202; 114/343
(58) Field of Search ..... 114/343, 71, 362, 114/202, 201 R

(56) References Cited

U.S. PATENT DOCUMENTS

| | | | | | |
|---|---|---|---|---|---|
| 1,100,216 | A | * | 6/1914 | Butler | 114/361 |
| 2,194,012 | A | * | 3/1940 | Dawson et al. | 114/202 |
| 3,039,417 | A | | 6/1962 | Hoffberg | 114/71 |
| 3,161,895 | A | | 12/1964 | Lewis | 114/343 |
| 3,165,726 | A | | 1/1965 | Riley et al. | 340/259 |
| 3,179,959 | A | | 4/1965 | McDougall | 114/343 |
| 3,183,874 | A | * | 5/1965 | Barlow | 114/202 |
| 3,216,716 | A | * | 11/1965 | Lunde et al. | 114/202 |
| 3,312,990 | A | * | 4/1967 | Lapworth | 114/71 |
| 3,602,183 | A | * | 8/1971 | Aarvold et al. | 114/202 |
| 4,425,861 | A | | 1/1984 | Raikamo | 114/71 |
| 4,685,411 | A | * | 8/1987 | Wick | 114/202 |
| 4,742,795 | A | | 5/1988 | Deprey et al. | 114/362 |
| 4,957,056 | A | | 9/1990 | Martin | 114/343 |

* cited by examiner

*Primary Examiner*—D. Glenn Dayoan
*Assistant Examiner*—Lars A. Olson
(74) *Attorney, Agent, or Firm*—Malin, Haley & DiMaggio, P.A.

(57) ABSTRACT

A sliding elevated pilot deck section ("SEPDS"), including a main deck segment with an upper portion and a lower portion and an engine compartment chamber generally in the middle of the upper portion of the main deck segment, a moving rear pilot deck assembly ("RPDA"), and means for moving the RPDA along the main deck section toward and away from the transom of the vessel.

43 Claims, 6 Drawing Sheets

SLIDING DECK ASSEMBLY PROVIDING ENGINE COMPARTMENT ACCESS

This application claims the benefit of provisional application No. 60/181,643 filed Feb. 10, 2000.

BACKGROUND OF THE INVENTION

1. Field of the Invention

This invention relates to a novel engine access compartment for marine vessels incorporating inboard drive assemblies and engines, and more particularly an apparatus which includes a raised pilot deck which slides rearwardly by means of an assembly allowing complete exposure to the engine room and drive system.

2. Description of Related Art

The prior art, with application to marine vessels, discloses known engine access assemblies which incorporate hinged mechanisms or components located in the forward end of the pilot deck area. Access is gained to the engine compartment by lifting the aft end, through hydraulic actuators or linkage assemblies. Such designs have several shortcomings, as they do not provide ample head room at the forward end of the engine compartment due to the forward end of the hinged assembly being in a fixed position. Such a hinged arrangement also prevents access between the forward cabin of the boat, and the cockpit area when the hatch or compartment is in the raised position. There is also an additional problem of such compartments or assemblies being substantial in weight, exceeding for example, 700 pounds. A boat owner would have to either hold up the compartment, or arrange for accessory mechanical components to be fixed in place, while working in the engine room. Such hinged assemblies tend to be bulky and awkward, and provide limited access to the engines and related assemblies or equipment. Moreover, they may be dangerous to the person working in the compartment, as the assembly might suddenly shift in high seas. The prior art does not teach or suggest structure which provides for a sliding or axially moving compartment or assembly, which can be completely removed from the access or entry area to the engine room. The prior art also does not teach or suggest mechanical linkages, hydraulics or other drive assemblies which can interact with guide rails and a moveable compartment or deck component, to easily and efficiently provide access.

U.S. Pat. No. 4,425,861 to Raikomo ("Raikomo") discloses a boat with an interior accommodation space. In Raikomo, the movable structure permits access to an interior cabin by frictionally sliding a movable structural part over a fixed cabin part. U.S. Pat. No. 3,165,762 to Hage demonstrates an intricate sliding top for the cabin of a boat. The Hage invention requires the use of latch bars to effect the sliding mechanism. In U.S. Pat. No. 1,100,216 to Butler ("Butler"), a sliding hinge for an engine hood is described. However, the Butler hinge is a single hinge down the center of the deck of the boat. Other relevant prior art, which does not solve the problems inherent in conventional engine access compartments, includes U.S. Pat. No. 3,039,417 to Hoffberg, U.S. Pat. No. 3,161,895 to Lewis, U.S. Pat. No. 3,179,959 to McDougall, U.S. Pat. No. 4,742,795 to DePrey et al., and U.S. Pat. No. 4,957,056 to Martin.

BRIEF SUMMARY OF THE INVENTION

The instant invention provides for an elevated pilot deck that slides back hydraulically, through use of a plurality of electric linear actuators or equivalent means. At least a portion of the pilot deck moves in a rearward direction, completely exposing the engines and related propulsion assemblies for easy access, simplifying maintenance procedures. This novel invention conceals the existence of the equipment access opening. It also makes access to the opening easier and allows equipment to remain in place around the deck to remain in place while the opening is accessed. Moreover, this invention efficiently and comfortably utilizes the space aboard the vessel by providing seating and access to other amenities while the equipment access opening is being accessed.

The sliding arrangement and track assembly of the instant invention solves the known problems with the prior art. In a particular embodiment, it is comprised of a single fiberglass hatch that can include passenger lounge seats, a bait freezer, ice maker, bait preparation station and tackle boxes. The hatch compartment is attached to the deck with dual track and side assemblies, positioned on opposite sides of the engine access area. The aft end of the hatch compartment is mounted on dual wheel assemblies. The wheels on this aft end support the weight of the hatch, while the tracks maintain the hatch in proper orientation and alignment. The entire hatch compartment slides in a rearward direction, toward the transom, using a hydraulic actuator, electric linear actuator, or equivalent electromechanical structure. Thus, the system allows for complete standing headroom in the engine compartment, as the pilot deck or hatch is completely removed from the maintenance area. It also allows for quick and easy access between the cockpit and the helm and the interior of the vessel, and it does not require great manual labor in manipulating a conventional hinged assembly.

The invention also has several beneficial features, in that it allows all the gear, hardware, appliances and other user friendly deck accessories to be unencumbered and level at all times. This is because this system simply allows for sliding movement of the entire pilot deck, without removal or manipulation of individual components. In contradistinction, a hinged, conventional system requires that all of these components, and the deck itself, be lifted to angles exceeding 45 degrees during maintenance procedures. Finally, the helm seat remains attached to the forward deck at all times, as the engine hatch assembly slides rearwardly, allowing the helmsman to continue to operate the boat while the engine access area is open.

This sliding elevated pilot deck section assembly is a unique apparatus, which many advantages over the prior are. It constitutes and assembly which is easily activated, and quickly removes at least a portion of the raised pilot deck from the engine access compartment, allowing for complete freedom and head room during maintenance procedures.

In accordance with these and other objects which will become apparent hereinafter, the instant invention will now be described with particular reference to the accompanying drawings.

It is an object of the instant invention to provide a cost effective and structurally superior mechanism for gaining access to the engine compartment.

It is a further object of the instant invention to provide a structural assembly which is completely removed from the engine and equipment access area during maintenance procedures.

It is a further object of the instant invention to provide a mechanical assembly which overcomes conventional systems, and particularly hinged assemblies which limit access to the engine room.

It is a further object of the instant invention to provide an engine room access assembly which allows a boat operator to continue operating the vessel, while the hatch is open and maintenance procedures are taking place.

It is further object of the instant invention to provide a sliding engine room access assembly which provides all of the above-mentioned features and objects.

DETAILED DESCRIPTION OF THE INVENTION

Figure 1:
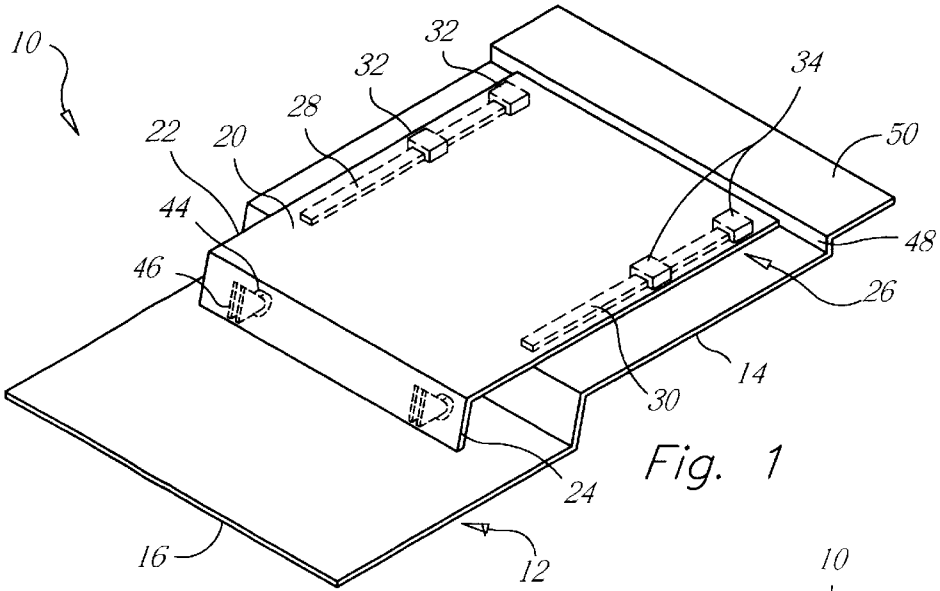
FIG. 1 is a perspective view of one embodiment of the invention in a closed state.

The invention is a sliding engine access assembly for a marine vessel, generally depicted in FIG. 1 at 10. The vessel has a hull, a deck and drive assemblies including mechanical and electrical components. As shown, the assembly 10 in the closed state makes the engine access opening virtually invisible, and the location of the deck becomes almost impossible to discern. When the assembly is in the open state, as described herein, the ease of access to the opening becomes apparent, and the benefit of a generally horizontally sliding portion of the pilot deck become apparent.

The assembly as shown in FIG. 1 comprises a main deck section 12, including an upper portion 14 and a lower portion 16. Located generally in the center of the upper portion is an equipment access opening 18, shown in FIGS. 2–4.

Figure 2:
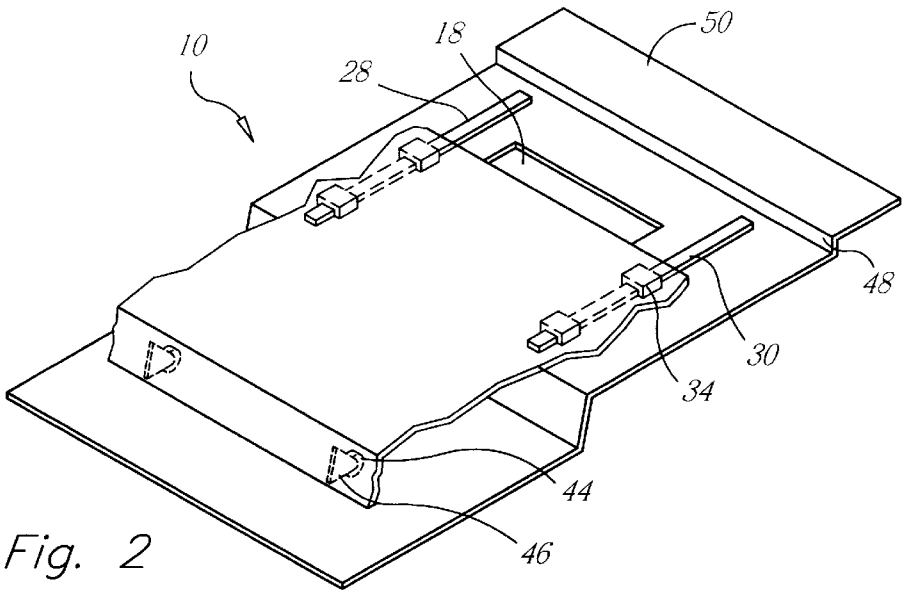
FIG. 2 is a perspective view of one embodiment of the invention in a partially open state.

A cover 20 for the opening 18 comprising a top portion 22 and a downward extending end portion 24 is located over the opening 18. As shown in FIG. 1, between cover 20 and the main deck section 12 is a means 26 for moving the cover along the main deck section 12 toward and away from the transom of the vessel. FIG. 2 depicts another embodiment of the invention, in which the cover 20 forms the base of an integrated seating area/deck module or similar module. The cover may be an intrinsically formed base of the module or the module may be permanently or releasably attached to the cover. Means of attachment include glue, screws, bolts or other equivalent means known in the art.

Figure 3:
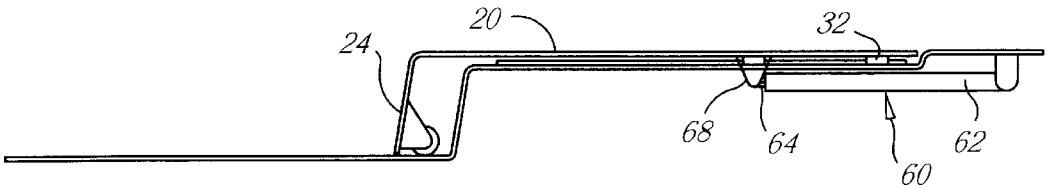
FIG. 3 is a side view of one embodiment of the invention in a closed state.
Figure 4:
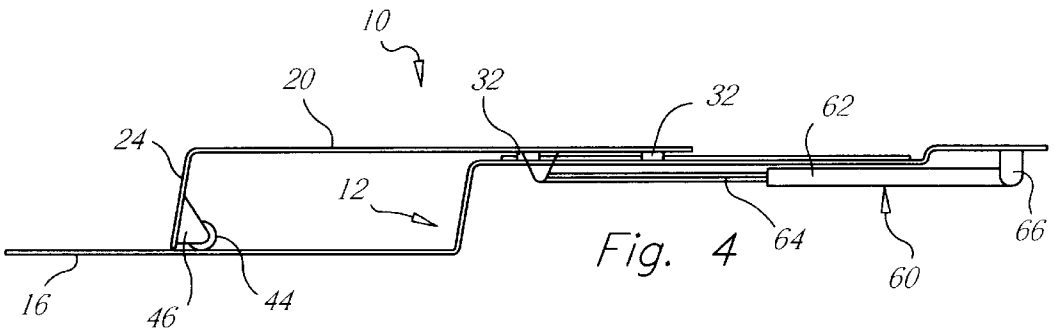
FIG. 4 is a side view of one embodiment of the invention in a partially open state.
Figure 5:
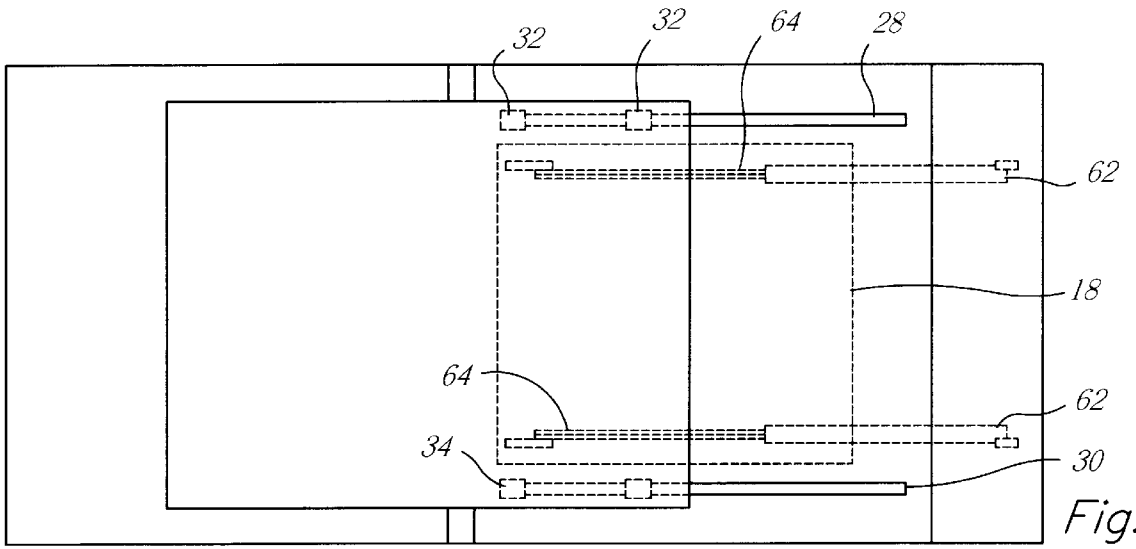
FIG. 5 is a top view of one embodiment of the invention in a partially open state.

In one embodiment, shown in FIGS. 3–5, at least one left side track 28 is attached to the upper portion 14 of the main deck section 12 on the left side of the opening 18, and a similar right side track 30 is attached to the upper portion 14 of the main deck section 12 on the right side of the opening 18. The tracks 28,30 may be attached to the upper portion 14 by glue, by screws, bolt or other mechanical means, or they may be formed intrinsically as part of the main deck section 12. At least one left side car 33 for moving along the left side track 28 and at least one right side car 34 for moving along the right side track 30 are preferably attached to the interior surface 36 of the cover 20. In the preferred embodiment, two spaced apart left side cars 32 and two spaced apart right side cars 34 are used.

Figure 6:
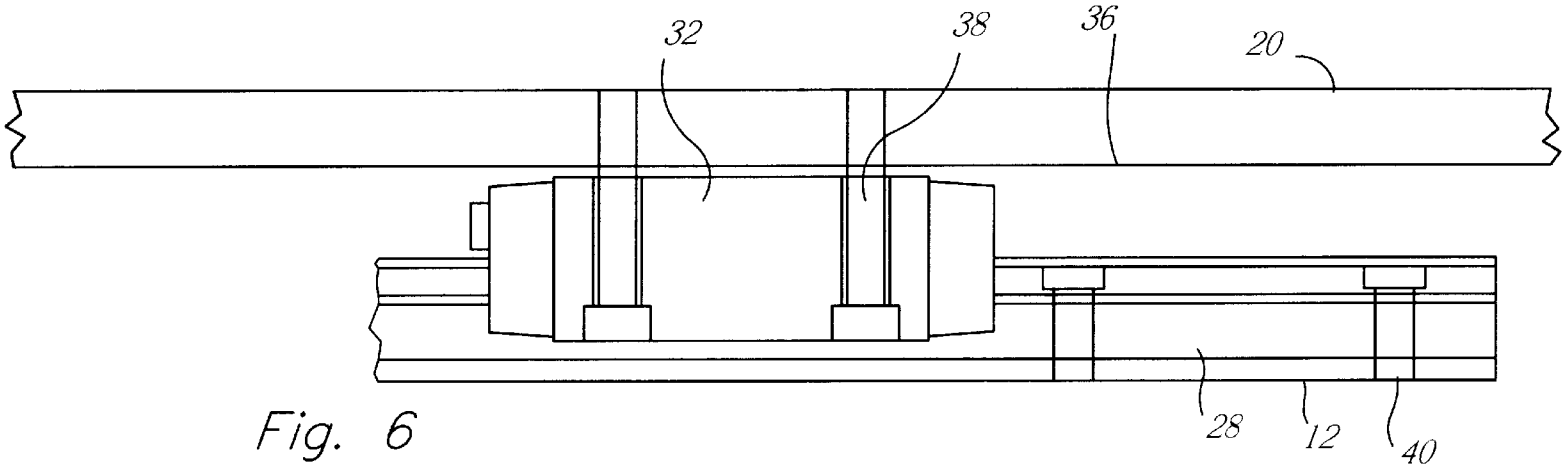
FIG. 6 is a side cut out view of the car and track assembly of one embodiment of the invention.
Figure 8:
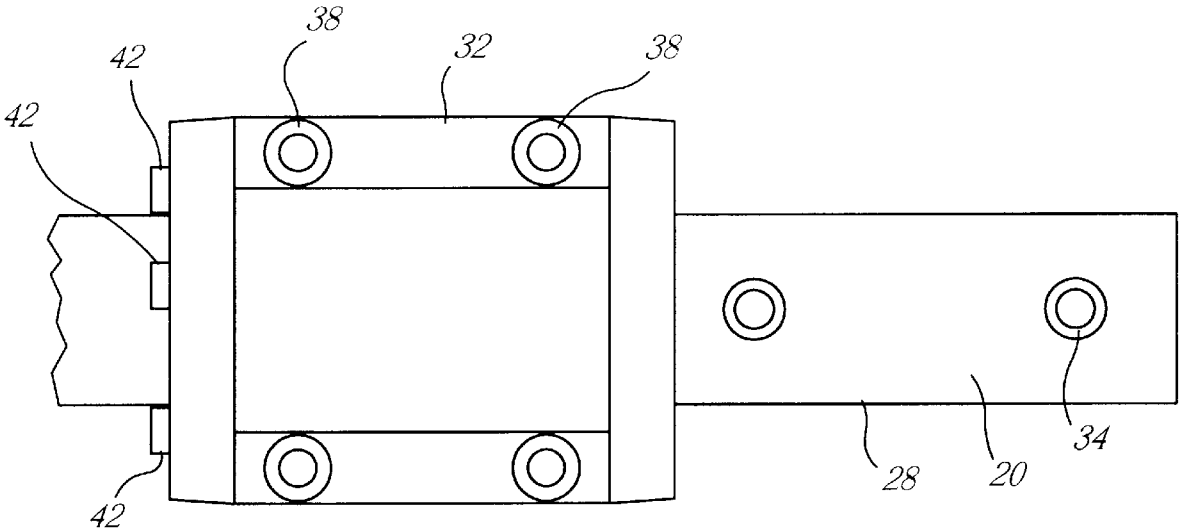
FIG. 8 is a top view of the car and track assembly of one embodiment of the invention.
Figure 7:
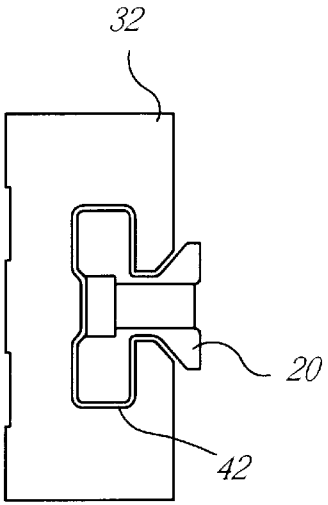
FIG. 7 is an end view of the car and track assembly of one embodiment of the invention.
Figure 11:
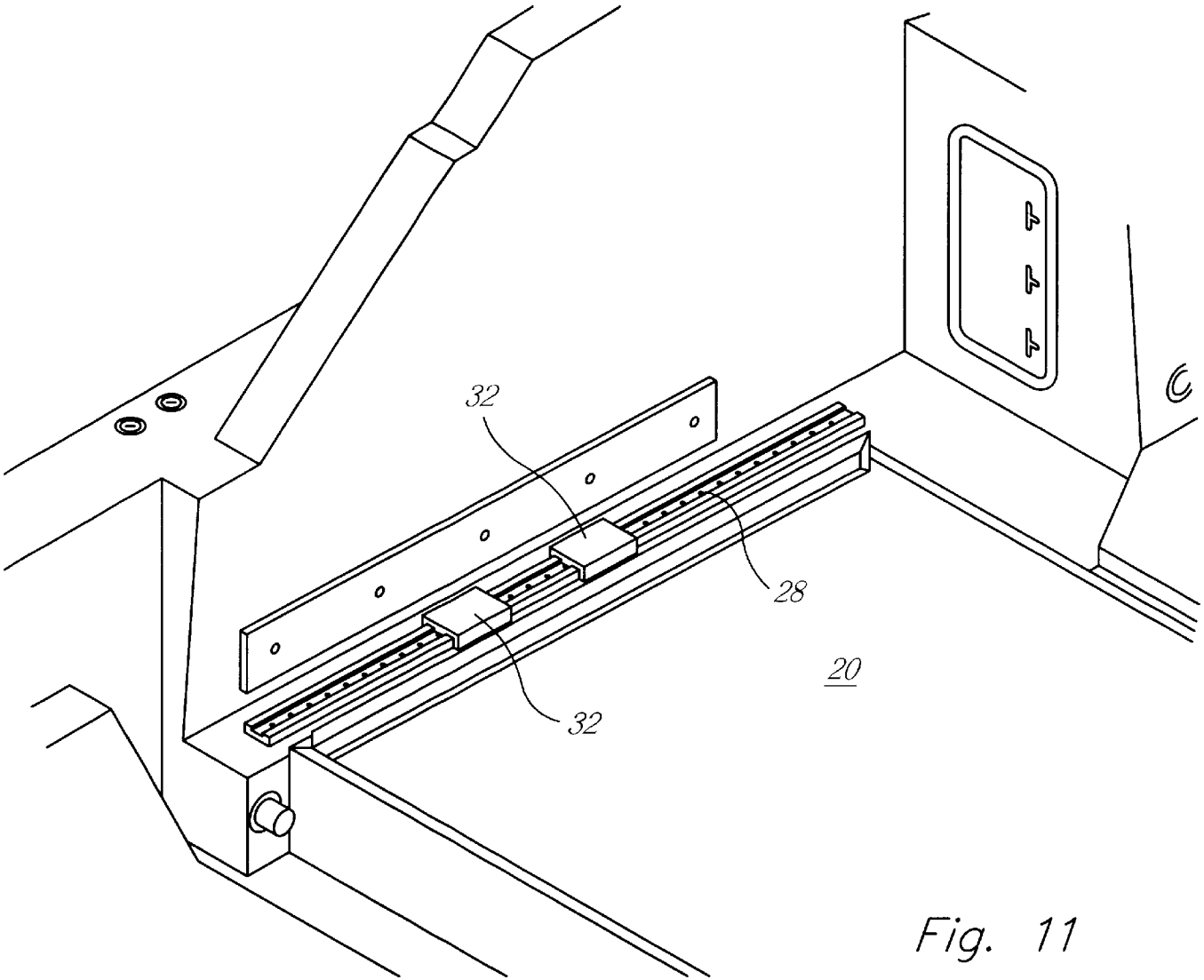
FIG. 11 is a close up perspective view of the car and track assembly with the car unattached to the moving rear pilot deck assembly of the preferred embodiment of the invention.

FIG. 11 depicts more clearly how the car and track system is applied in the context of a cover 20 comprising a seating area/deck module. FIGS. 6–8 depict one of the car and track assemblies, which will be referred to as the left side for convenience. As shown, the car 32 is attached to the interior surface 36 of the cover 20 by a bolt 38. However, other equivalent means for attachment are also contemplated, such as glue, screws, or intrinsic forming during the manufacture of the cover 20. Also, the preferred track 28 is T-shaped, so that the track 28 forms a guide for the cover 20 as it moves on the car 32. Other track shapes are also considered. In addition, in the preferred embodiment, the track 28 is attached to the main deck 14 by screws 40. As shown in FIG. 7, the car 32 may have generally flat contact surfaces 42 with the track 28. Reduced friction polymers as are known in the art are preferred for the contact surface 42 of the car 32. However, roller surfaces may also be used. In addition, the contact surfaces 42 of the car may be adjustable for optimal use on the track 28.

Also, at least one wheel 44 is attached to the end portion of the cover, wherein the wheel 44 moves along the lower portion 16 of the main deck section. The wheel 44 serves to help move the cover 20 as well as support the weight of the cover 20. In the preferred embodiment, two wheels 44 are attached to trucks 46 located on the interior surface 36 of the cover 20. Preferably, the wheels 44 are fixed to the cover 20 so that the wheels 44 may only move away from and toward the transom. Also, it is preferred that the one or more wheels 44 are of non-marring polyurethane. Other locations, means of attachment and materials for the wheels 44 are known in the art and are contemplated by this invention. Preferably, a dual wheel assembly is used.

In another embodiment, generally depicted in FIGS. 1 and 2, the upper portion 14 of the main deck section 12 further includes a lip 48 and a crown 50. Thus, the top end 22 of the cover 20, when closed, lies generally flush with the crown 50. Although FIG. 2 does not show the cover 20 extending to the boundaries of the main deck section 12, either at the upper portion 14, the lower portion 16, or both, these configurations are also contemplated.

Figure 9:
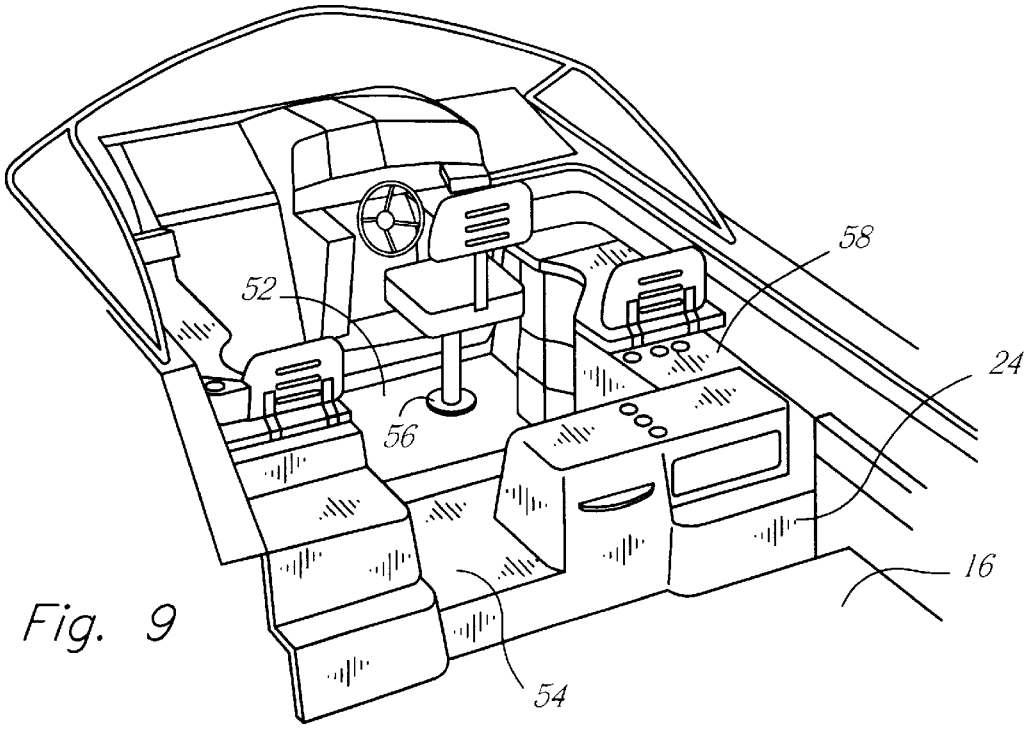
FIG. 9 is a perspective view of the preferred embodiment of the invention in the closed state.
Figure 10:
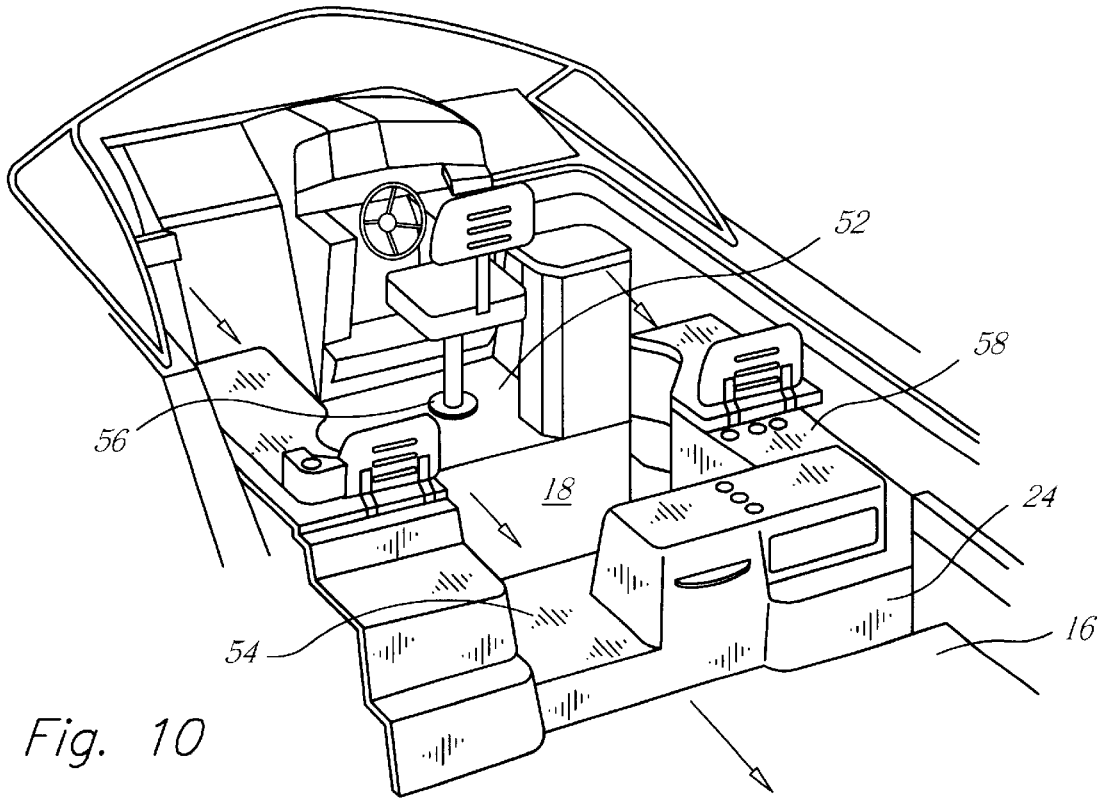
FIG. 10 is a perspective view of the preferred embodiment of the invention in the open state.
Figure 12:
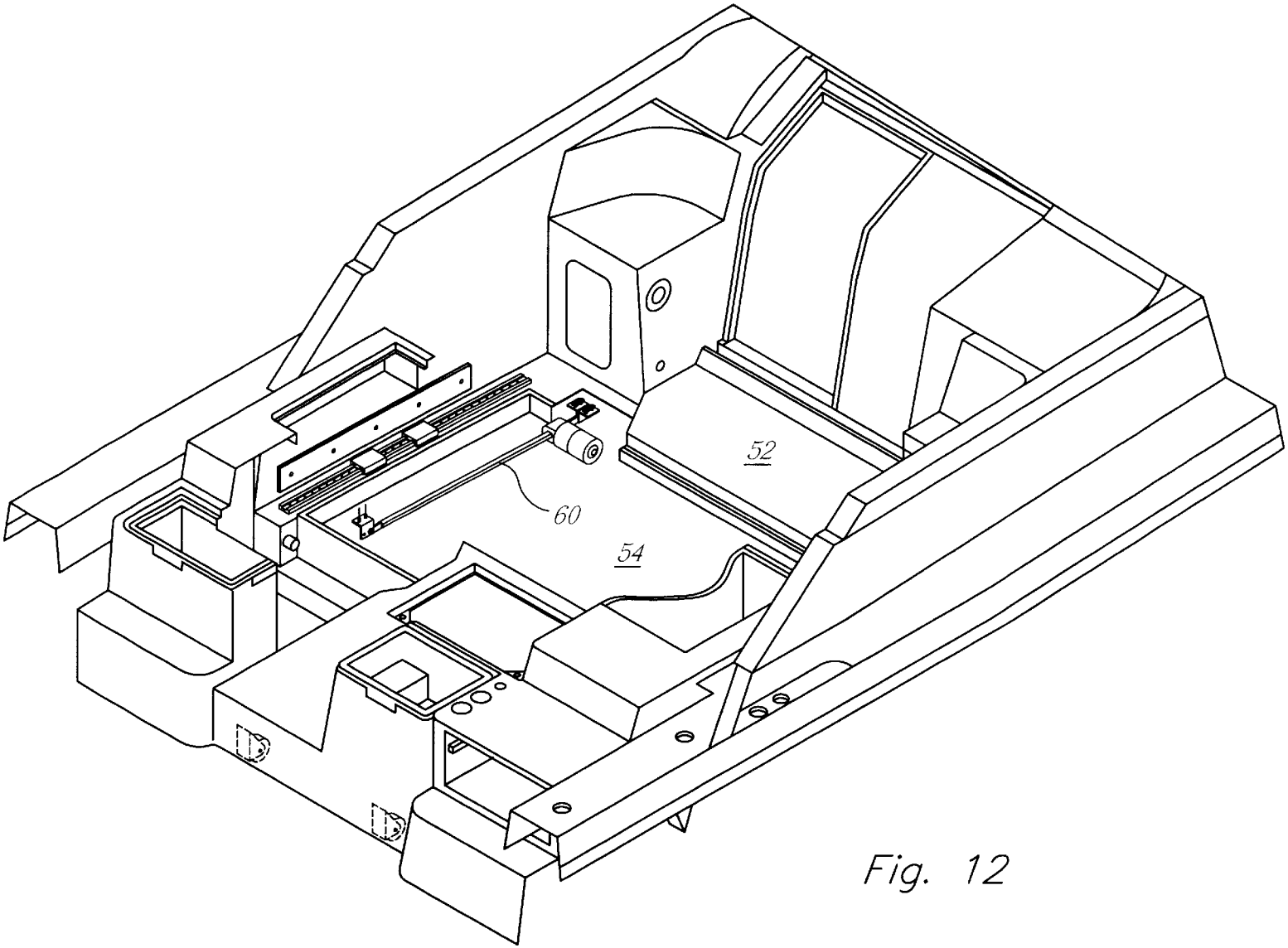
FIG. 12 is a perspective view of the moving rear pilot deck assembly of the preferred embodiment of the invention.

Moreover, as depicted in FIGS. 9, 10 and 12, the upper portion 14 of the main deck section 12 may include a forward pilot deck element 52, and the top portion 22 of the cover 20 may comprise a rear pilot deck element 54. In one embodiment of this configuration, the pilot deck function of the cover 20 conceals the cover of the engine access opening function of the cover. As illustrated in FIGS. 9 and 10, the upper portion 14 of the main deck section 12 may also comprise an operator station 56, allowing a boat operator to continue operating the vessel, while the engine access opening 18 is open and maintenance procedures are taking place. Moreover, the cover 20 may comprise an integrated seating area/deck module 58. The module may include any combination of passenger lounge seats, a bait freezer, ice maker, bait preparation station and tackle boxes. Thus, the module is removed from the engine access area during maintenance procedures. In addition, gear, hardware, appliances and other user friendly deck accessories remain unencumbered and level at all times in which the engine access opening is open.

In an embodiment in which the cover comprises an integrated seating area/deck module 58, as shown in FIGS. 9 and 10, the invention comprises a sliding elevated pilot deck section ("SEPDS"), including a main deck segment with an upper portion and a lower portion and an engine compartment chamber generally in the middle of the upper portion of the maine deck segment, a moving rear pilot deck assembly ("RPDA"), and means for moving the RPDA along the main deck section toward and away from the transom of the vessel. In this embodiment, the means for moving the RPDA include those described above in the embodiment including the cover 20 and their equivalents.

In another embodiment, depicted in FIGS. 3–5 and 12, the assembly 10 comprises means for moving the cover 20 toward and away from the transom. In the preferred embodiment, at least one actuator 60 is used for moving the cover 20 generally toward and from the transom. In the preferred embodiment, two actuators 60 are used: one near the left side of the opening 18 and one near the right side of the opening 18. As shown in FIGS. 3–5, the actuators 60 may comprise a near element 62 and a far element 64. FIGS. 3, 4 and 12 depict the left side of the assembly 10, although they are representative of the right side as well. The near element 62 may be attached by means of attachment to the interior surface of the upper portion 14 of the main deck section 12 at a near element attachment point 66, and the far element is attached by means of attachment to the interior surface of the top portion 22 of the cover 20 at a far element attachment point 68. Preferably the elements 62,64 are attached to the attachment points 66,68 by screws or bolts, but equivalent means for attachment are contemplated. The near element 62 and the far element 64 are moveably connected to each other. Preferably, the far element 64 telescopes into the near element 62, however, equivalent connections are contemplated. This embodiment is especially useful for the elderly or the handicapped owner that would not otherwise be able to open the equipment access area without the one or more actuators. In addition, FIG. 12 illustrates one the components in the preferred invention for the attachment of the actuator 60 to the forward pilot deck element 52 and the rear pilot deck element 54, including bolts, washers and generally L-shaped joints. However, equivalent means for attachment are also contemplated in this invention.

In addition, one or more intermediate telescoping elements may be located between the near element 62 and the far element 64. Preferably, the actuators 60 are linear electric actuators, as are known in the art. However, they may also be hydraulic or operated by a chain linkage or similar system.

In alternative embodiments, the cars 32,34 may be affixed to the main deck section 12 while the tracks 28,30 are affixed to the cover 20. Other equivalent mechanisms for moving the cover 20 are contemplated.

The above stated configurations of the assembly 10 improve access to the equipment access opening 18 while concealing the opening 18 when the cover 20 is closed, making the opening 18 unobtrusive and unapparent during boating operations. The moveable deck is moveable to several positions. Moreover, the moveable deck is integrated with the vessel deck while it is also a discrete component thereof.

Furthermore, the entire engine access compartment may completely be exposed, allowing access to the engine and inboard drive systems, including the electrical and hydraulic systems. The assembly 10 more efficiently uses space on the boat than has been available under the prior art. This efficiency is especially notable in the dual-functioning integrated seating area/deck module 58 configuration, since seating space will be available where in the prior art a hinged hatch or obtrusive hatch cover would crowd the deck area.

Furthermore, the invention would benefit the elderly and the handicapped boater, since easy access to the equipment access opening is now possible with the touch of a button to turn on the actuator or actuators. Moreover, any items, including passengers, placed on top of the closed dual function module may remain safely in place as the module is moved. Since items normally stored on the module do not have to be stored elsewhere while the opening is being accessed, access may be obtained more quickly that is possible in the prior art.

Additionally, the hinge which would be on the deck in the prior art is no longer there, thereby making the deck smooth and without possible obstructions that a passenger may trip over. Thus the boat has also been made safer to operate.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A sliding deck assembly for providing access to a vessel equipment compartment, said vessel having a hull, a deck and drive assemblies, including mechanical and electrical components, comprising:

deck means for providing a useful deck surface on the vessel while the vessel is in operation, said deck means including at least a portion of a pilot deck, said deck means being moveable to several positions and being integrated with said vessel deck, and said deck means being a discrete component thereof;

sliding assembly means secured to said deck means and to said vessel for providing movement of said deck means;

equipment access means within said vessel deck for providing access to said equipment compartment; and said deck means concealing said equipment access means when said deck means is in a first position, and exposing said equipment access means when said deck means is in a second position;

whereby said sliding deck assembly completely conceals said equipment compartment when said vessel is in normal operation, and provides quick and efficient access to said mechanical and electrical components for maintenance or repair operations.

2. The sliding deck assembly of claim 1, wherein the deck means further comprises an operator station.

3. The sliding deck assembly of claim 1, wherein said deck means further includes one or more of the following: seats, a bait freezer, ice maker, bait preparation station and tackle boxes.

4. The sliding deck assembly of claim 1, wherein said sliding assembly further comprises an electric linear actuator.

5. The sliding deck assembly of claim 1, wherein said sliding assembly further comprises a hydraulic actuator.

6. The sliding deck assembly of claim 1, wherein the sliding assembly further comprises a car and track system.

7. A sliding engine access assembly for a vessel, said vessel including a hull and a transom, comprising:

a main deck section, an equipment access opening located generally in the middle of the main deck section, a cover means for at least partly enclosing the opening, said cover means including a useful deck surface means for providing a functional surface that is an integral portion of a raised pilot deck, and means for sliding said cover means toward and away from a transom, said cover means remaining in a generally horizontal plane;

whereby the cover means conceals said equipment access opening when the vessel is in normal operation and provides quick and efficient access to said opening when the cover means has been moved toward the transom.

8. The sliding engine access assembly of claim 7, wherein the means for sliding includes a car and track assembly on the cover means and the main deck section.

9. The sliding engine assembly of claim 8, wherein the car and track assembly comprises at least one left side track attached to the upper portion of the main deck section on the left side of the opening and at least one right side track attached to the upper portion of the main deck section on the right side of the opening, and at least one left side car for moving along the left side track and at least one right side car for moving along the right side track, wherein the left side car and the right side car are attached to the interior surface of the cover means.

10. The sliding deck assembly of claim 7, wherein the cover means further comprises at least one wheel attached to the end portion of the cover means.

11. The sliding deck assembly of claim 7, wherein the means for sliding further comprises one or more actuators for moving the cover means generally to and from the transom.

12. The sliding deck assembly of claim 11, wherein the actuator comprises a near element attached to the interior surface of the upper portion of the main deck section, and a far element attached to the interior portion of the top portion of the cover means, wherein the near element is moveably connected to the far element.

13. The sliding deck assembly of claim 11, wherein the one or more actuators are electronically activated screw jack systems.

14. The sliding deck assembly of claim 11, wherein the one or more actuators are hydraulic.

15. The sliding deck assembly of claim 12, wherein the far element telescopes within the near element.

16. The sliding deck assembly of claim 12, wherein one or more intermediate elements is located between the near element and the far element.

17. The sliding deck assembly of claim 7, wherein the upper portion of the main deck section comprises a lip and a crown, whereby the top end of the cover means, when closed, lies generally flush with the crown.

18. The sliding deck assembly of claim 8, wherein the left side track and the right side track are generally T-shaped.

19. The sliding deck assembly of claim 7, wherein the upper portion of the main deck section comprises a forward pilot deck element, and the top portion of the cover means comprises a rear pilot deck element.

20. The sliding deck assembly of claim 19, wherein said cover means comprises an integrated seating area/deck module.

21. The sliding deck assembly of claim 20, wherein the pilot deck function of the cover means conceals the cover of the engine access opening function of the cover means.

22. The sliding deck assembly of claim 20, wherein the forward pilot deck element comprises an operator station.

23. A sliding elevated pilot deck section ("SEPDS") providing access to an engine compartment chamber for a vessel, said vessel having a hull and a transom and a main deck segment and drive assemblies including mechanical and electrical components, comprising:

stationary deck means for providing a main deck segment, a moving rear pilot deck assembly ("RPDA") means for providing a deck area, said RPDA means being integrated with the main deck segment, said RPDA means being a discrete component thereof, and sliding means secured to said deck means and said RPDA means for providing movement for a moving rear pilot deck assembly ("RPDA") means toward and away from the transom;

whereby the moving RPDA means conceals the engine compartment chamber in normal operation and provides quick and efficient access to mechanical and electrical components when the RPDA is moved toward the transom.

24. The SEPDS of claim 23, wherein the main deck segment comprises a forward pilot deck assembly.

25. The SEPDS of claim 23, wherein the forward pilot deck assembly further comprises an operator station.

26. The SEPDS of claim 23, wherein the sliding means comprises a car and track assembly.

27. The SEPDS of claim 23 wherein said car and track assembly comprises:

at least one left side car for moving along the left side track and at least one right side car for moving along the right side track, wherein the left side car and the right side car are attached to the interior surface of the RPDA means.

28. The SEPDS of claim 23, wherein the sliding means comprises at least one actuator for moving the RPDA means generally laterally in relation to the chamber.

29. The SEPDS of claim 28, wherein said actuator comprises a near element attached to the interior surface of the upper portion of the main deck segment, and a far element attached to the interior portion of the top portion of the RPDA means, wherein said near element is moveably connected with said far element.

30. The SEPDS of claim 28, wherein the one or more actuators are electronically activated screw jack systems.

31. The SEPDS of claim 28, wherein the one or more actuators are hydraulic.

32. The SEPDS of claim 28, wherein the far element of said actuator telescopes within the near element of said actuator.

33. The SEPDS of claim 28, wherein sliding means comprises a wheel attached to the interior surface of the RPDA means.

34. The SEPDS of claim 32, wherein one or more intermediate elements is located between said near element of the actuator and said far element of the actuator.

35. The SEPDS of claim 23, wherein the upper portion of the stationary deck means comprises a lip and a crown, whereby the top end of the RPDA lies generally flush with the crown.

36. The SEPDS of claim 27, wherein the left side track and the right side track are generally T-shaped.

37. The SEPDS of claim 36, wherein the left side car and the right side car comprise a generally flat contact surface with the left side track and the right side track.

38. The SEPDS of claim 27, wherein the upper portion of the stationary deck means comprises a forward pilot deck element, and the top portion of the RPDA means comprises a rear pilot deck element.

39. The SEPDS of claim 38, wherein the pilot deck function of the RPDA means conceals the cover of the engine access opening function of the RPDA means.

40. The SEPDS of claim 23, wherein the assembly is an integrated seating area/deck module.

41. The SEPDS of claim 23, wherein the RPDA means and the stationary deck means form an integrated pilot deck for the vessel when the RPDA means is in the closed position.

42. A sliding elevated pilot deck section ("SEPDS") for a vessel having a hull and a transom and equipment including mechanical and electrical components, comprising:

a main deck, an equipment access opening located generally in the middle of the upper portion of the main deck, a rear deck assembly ("RDA") moveable to several positions, said RDA being integrated with the main deck, said RDA being a discrete component thereof, and sliding means for moving the RDA along the main deck segment toward and away from the transom;

whereby the RDA conceals the opening when the vessel is in normal operation and provides quick and efficient access to the equipment when the RDA is moved toward the transom.

43. A sliding deck assembly for providing access to a vessel equipment compartment on a vessel deck, comprising:

a deck means for providing a useful deck surface on said vessel, said deck means including at least a portion of a pilot deck, said pilot deck being moveable to several positions, and being integrated with said vessel deck.

* * * * *